United States Patent [19]

Schelfhaudt

[11] Patent Number: 5,048,551

[45] Date of Patent: Sep. 17, 1991

[54] FLOATING INSECT SCREEN

[76] Inventor: James W. Schelfhaudt, 3775 Spring Lake Rd., Jacksonville, Fla. 32210

[21] Appl. No.: 544,267

[22] Filed: Jun. 26, 1990

[51] Int. Cl.[5] ..... E04H 15/24

[52] U.S. Cl. ..... 135/100; 135/105; 135/116; 441/38

[58] Field of Search ..... 135/100, 87, 105, 116, 135/117, , 900–902; 272/1 B, 1 R; 441/38, 43, 136, 80; 114/349

[56] References Cited

U.S. PATENT DOCUMENTS

| | | | |
|---|---|---|---|
| 1,850,380 | 3/1932 | Carpenter | 135/100 X |
| 1,960,001 | 5/1934 | Davies | 135/105 X |
| 3,092,854 | 6/1963 | Manhart | 441/38 |
| 3,768,467 | 10/1973 | Jennings | 441/38 X |
| 4,554,937 | 11/1985 | Irwin | 135/100 |

*Primary Examiner*—David A. Scherbel
*Assistant Examiner*—Lan Mai
*Attorney, Agent, or Firm*—Thomas C. Saitta

[57] ABSTRACT

A floating insect screen for personal use on a pool or lake comprising a floating base member defining a large central opening to surround the user, relatively upright vertical members attached to said base member, and a mesh material attached between and to said upright members and said base member. The mesh material forms a closed interior where the only entry is from the water by way of the opening in the base member, so that insects are prevented form reaching the user.

9 Claims, 2 Drawing Sheets

FLOATING INSECT SCREEN

BACKGROUND OF THE INVENTION

The invention relates to the field of screen structures to preclude insects from an enclosed area. More particularly, the invention relates to the field of floating screen structures adapted to be used by an individual swimmer in a pool or lake.

Recreation in the warm summer months often involves activities in a swimming pool or lake. Unfortunately, the summer months also bring out a proliferation of biting or stinging insects which greatly hinder the enjoyment of such activities. In the case of swimming pools, many owners have resorted to the construction of costly screen enclosures surrounding the entire pool area. While this alleviates the bug problem, the large enclosures are unsightly and block out sunlight. They are permanent additions requiring upkeep which are not removable during the times when insects are not a problem. Thus there is a need for an inexpensive, temporary solution to the insect problem which provides protection when needed but is easily put aside when not needed.

It is an object of this invention to provide a floating insect screen which protects the user from insects without hindering the enjoyment of the pool or lake. It is a further object to provide such a device sized to meet the needs of an individual user. It is a further object to provide such a device that is mobile, whereby the user can move about in the water with the device moving with the user.

BRIEF SUMMARY OF THE INVENTION

The invention comprises a floating base having a relatively large central opening, of sufficient buoyancy to support a structural framework above the surface of the water. A screen or mesh material is attached to said framework and to said floating base to form a closed area within the interior of the framework, the screen forming a barrier between the interior of the device and the outside environment. The screen prevents insects from entering the interior of the device, while minimally interfering with sunlight and breeze and allowing the user to freely communicate through said screen with sound and vision. The user utilizes the device by positioning his torso within the opening of the base, such that all parts of his body exposed above the water are within the interior of the device.

DETAILED DESCRIPTION OF THE INVENTION

Figure 1:
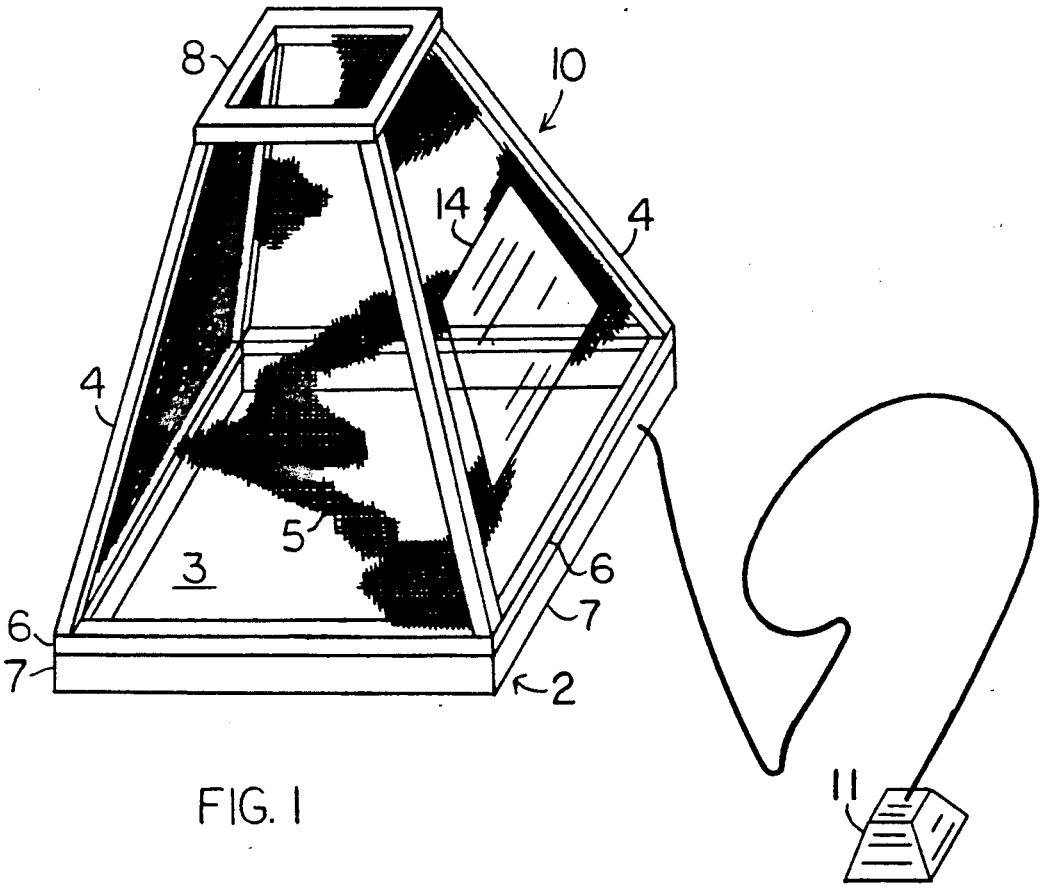
FIG. 1 is a perspective view of one embodiment of the device, with portions of the mesh material removed for clarity.

With reference to the various drawings accompanying this disclosure, the device can be seen to generally comprise a floating base member 2 having a relatively large, unclosed opening 3, the base member 2 supporting a framework 10 comprising relatively upright members 4 to which is attached a mesh material 5. The mesh material 5 defines an enclosed interior area within the device, whereby the only entry into this interior area is through the large opening 3.

Floating base member 2 is preferably of relatively thin or small cross-section, forming a closed perimeter structure defining a relatively large opening 3 in its interior. Base member 2 can be constructed of any material which will provide buoyancy, such as cork, plastic (self-floating or inflatable), foam, wood, etc., and which will be sufficiently rigid to support the upright framework 10. Alternatively, base member 2 may additionally comprise a horizontal frame member 6 constructed of rigid tubing or other structural materials, such as plastic or aluminum pipes or bars, to which floating materials 7 are then attached, as seen in FIG. 1. The opening 3 must be of sufficient size to allow easy ingress and egress by the user and must therefore be a minimum of several feet across so that the base member 2 will surround the torso of the user. The opening 3 is such that when base member 2 is floating on the water surface 20, passage through base member 2 requires passage from air to water or vice versa. It is alternatively possible to create a much larger base member 2 if additional flotation or surface area is desired.

Figure 2:
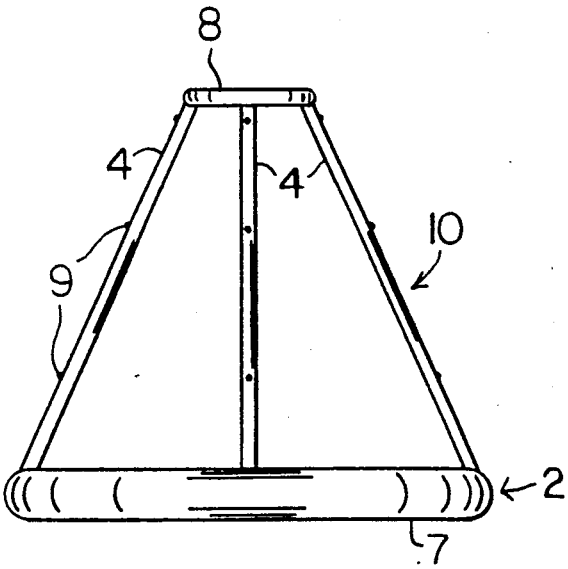
FIG. 2 is a side view of an alternative embodiment of the framework structure of the device.

The particular shape of the base member 2 and the opening 3 is a matter of design choice. Base member 2 may be square as shown in FIG. 1, circular as shown in FIG. 2, or of any other shape which enables the framework 10 and mesh 5 to remain stable on the surface of the water 20.

Figure 3:
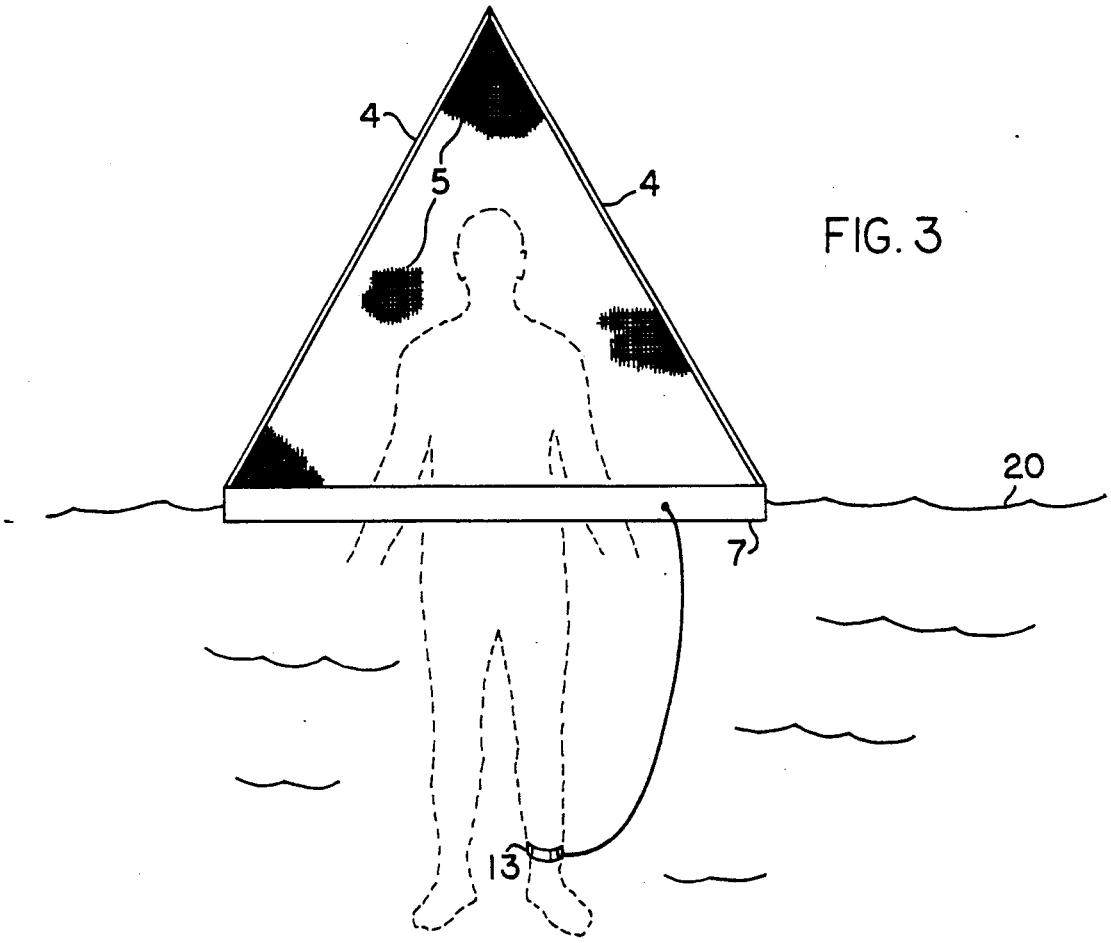
FIG. 3 is a side view of device shown in use.

Attached to base member 2 are relatively vertical upright members 4. These upright members 4 are rigid and provide the support for the mesh material 5. The framework 10 may consist only of a plural number of upright members 4 as seen in FIG. 3, in which case said upright members 4 will meet at the top in a pyramid-shaped arrangement. Alternatively, the upright members 4 may be capped by a relatively horizontal upper perimeter member 8. This upper perimeter 8 may be square, as shown in FIG. 1, circular, as shown in FIG. 2, or of any other suitable shape. The upper perimeter 8 may be solid or covered by the mesh material 5. Preferably, the upright members 4 and upper perimeter 8 are constructed of rigid plastic tubing, such as PVC pipe, but they may be constructed of any suitably rigid and lightweight material such as aluminum, wood, etc. The upright members 4 and upper perimeter 8 are attached to each other by any common method, such as adhesive bonding, mechanical fasteners, friction fits, etc. Likewise, the upright members 4 may be attached to the base member 2 by any of the same methods. Furthermore, the framework 10 members may be molded into a one-piece structure.

Figure 5:
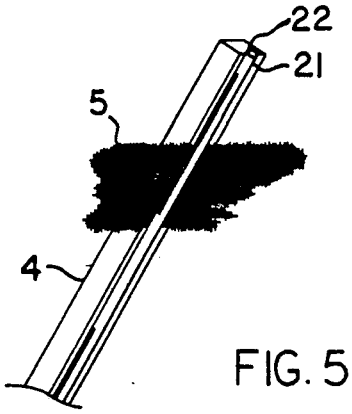
FIG. 5 is a partial view of a portion of the framework and screen, showing one method for attachment.

Mesh material 5 is stretched between the upright members 4, and across upper perimeter 8 if present, to define an enclosed interior area within framework 10. Mesh material 5 may be of any suitable flexible material having relative small openings to preclude insects from traveling through the material. Common metal or plastic screening is ideally suitable for this. The mesh material 5 is attached to the upright members 4, the upper perimeter 8 and to the base member 2 or horizontal frame 6 by any suitable method such as adhesive bonding, mechanical fasteners such as rivets 9 (as seen in FIG. 2), or by the use of plastic spline material 21 inserted into a groove 22 (as seen in FIG. 5). Additionally, the upright members 4 can be molded directly onto the mesh material 5. With whatever method used, the mesh material 5 must completely enclose the framework 10 and the base member 2, such that the only opening of significant size to the interior of the device is through opening 3 in the base member 2.

Figure 4:
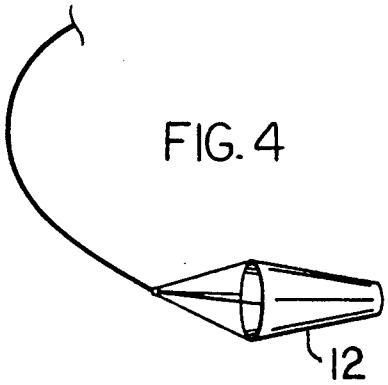
FIG. 4 is a perspective view of a sea anchor attachable to said device.

It may be preferable in certain situations, such as where currents are present, to provide means to anchor the device in a particular location. This may be accomplished by the connection of a weighted anchor 11 to the base member 2, as seen in FIG. 1, or by use of a sea anchor or drogue 12, shown in FIG. 4. Alternatively, it may be desired to attach the device to the user, in which case a tether 13 is used, as in FIG. 3. Additionally, portions of the mesh material 5 may be replaced by transparent plastic to form a viewing window 14, as seen in FIG. 1.

The above illustrations and variations of the invention are set forth for purposes of illustration only, and it may be obvious to those skilled in the art to make changes in the nature of substitutions or equivalents. The full scope and definition of the invention is therefore to be as set forth in the following claims.

I claim:

1. A floating insect screen comprising:

(A) a base member adapted to float on the surface of water, said base member having a perimeter defining a relatively large, unclosed opening on said water surface of sufficient size to surround a human torso;

(B) relatively upright, rigid frame members attached to said base member; and (C) a mesh material attached between and to said upright frame members and to said base member, said mesh material defining a closed interior area above said water surface, whereby said large opening in said base member provides the only entry into said interior area, said mesh material having openings sufficiently small in size to preclude insects from entering said interior area

2. The device of claim 1, further comprising an upper perimeter member attached to said upright frame members.

3. The device of claim 2 where said mesh material is attached between and to said upper perimeter.

4. The device of claim 1, where said base member comprises a horizontal frame member and floating materials attached to said horizontal frame member.

5. The device of claim 1, further comprising an anchor attached to said base member.

6. The device of claim 1, further comprising a drogue attached to said base member.

7. The device of claim 1, further comprising a tether attached to said base member.

8. The device of claim 1, further comprising a solid, transparent plastic member connected to said mesh material.

9. The device of claim 1, where said upright members have grooves, and said mesh material is attached to said upright members by a spline material inserted into said grooves.

* * * * *